United States Patent [19]

Kise

[11] 4,290,215

[45] Sep. 22, 1981

[54] BADGE WITH PIN

[76] Inventor: Yaeko Kise, 35-10 Asakusabashi 1-chome, Taito-ku, Tokyo, Japan

[21] Appl. No.: 107,705

[22] Filed: Dec. 27, 1979

[30] Foreign Application Priority Data

Oct. 12, 1979 [JP] Japan ..... 54-140969[U]

[51] Int. Cl.[3] ..... A44C 3/00

[52] U.S. Cl. ..... 40/1.5; 40/20 R; 40/24

[58] Field of Search ..... 24/3 R; 40/1.5, 1.6, 40/24, 20, 25

[56] References Cited

U.S. PATENT DOCUMENTS

| | | | |
|---|---|---|---|
| 1,528,513 | 3/1925 | Smythe | 40/24 |
| 1,999,786 | 4/1935 | Rosenblum | 40/1.5 |
| 4,000,570 | 1/1977 | Carmen | 40/24 |

FOREIGN PATENT DOCUMENTS

| | | | |
|---|---|---|---|
| 229954 | 3/1925 | United Kingdom | 40/1.5 |

*Primary Examiner*—Gene Mancene
*Assistant Examiner*—Wenceslao J. Contreras
*Attorney, Agent, or Firm*—Toren, McGeady & Stanger

[57] ABSTRACT

A badge includes a pin for securing the badge to a garment. The pin comprises a resilient wire member bent substantially in a rectangle in a manner that the opposite ends of the wire member are located at one corner thereof. The pin has a hook portion at one end and a sharp point at the other end, which is engageably fitted into the hook. A prong having a sharp point of the wire member and a stem opposing thereto are spaced apart from each other by a distance larger than a thickness of a thumb or forefinger, so that engagement and disengagement of the prong having a sharp point with and from the hook is facilitated, thereby providing ease of attachment or removal of the badge to or from the garment.

4 Claims, 4 Drawing Figures

BADGE WITH PIN

BACKGROUND OF THE INVENTION

1. Field of the Invention

This invention relates to a badge or a name tag with a pin.

2. Description of the Prior Art

In a prior art badge with a pin on the back surface thereof, an insertion prong and a hook, of the pin are positioned in close proximity to the back surface of the badge, because such a pin has no support prong, resulting in less ease of handling the pin for securing the badge to a garment. In extreme cases, it has been experienced that a garment is broken by the insertion prong when sticking in the garment.

SUMMARY OF THE INVENTION

It is an object of the present invention to provide a badge with a pin which is easy to be affixed to a garment or the like.

It is another object of the present invention to provide a pin which is capable of supporting a badge on the hem of a pocket in a garment, without engaging or disengaging an insertion prong with or from a hook of the pin.

It is a further object of the present invention to provide a badge with a pin, which is stably held on a garment without dangling which would be caused by an incresaed length of support prongs of the pin, after the insertion prong has been fitted into the hook and locked thereby.

To attain the objects, there is provided a badge which includes a pin for securing the badge to a garment or the like, the pin comprising a resilient wire member bent substantially in a rectangle in a manner that the opposite ends of the rectangular wire member are positioned at one corner thereof, and the wire member having a hook at one end and a sharp point at the other end, which is engageably fitted into the hook. A prong with a sharp point of the pin and a stem opposing thereto are spaced apart from each other by a distance larger than a thickness of a thumb or forefinger, so that engagement or disengagement of the prong having a sharp point with or from the hook is facilitated, thereby providing ease of attachment or removal of the badge to or from a garment. Support prongs of the pin which interconnect the prong having a sharp point and the stem opposing thereto have a length long enough to be stably held on a hem or edge of a pocket in a garment when the pin on the back surface of the badge is inserted into the pocket, without causing the prong having a sharp point to pierce through a garment.

According to the present invention, there is provided on the back surface of a badge a means for separably locking support prongs on the back surface of the badge. After the insertion prong of the pin has been locked by the hook, the support prongs of the pin are immovably secured by the fixing means to the back surface of the badge, whereby the badge is settled in place, without a likelihood of dangling.

DESCRIPTION OF THE PREFERRED EMBODIMENTS

Figure 1:
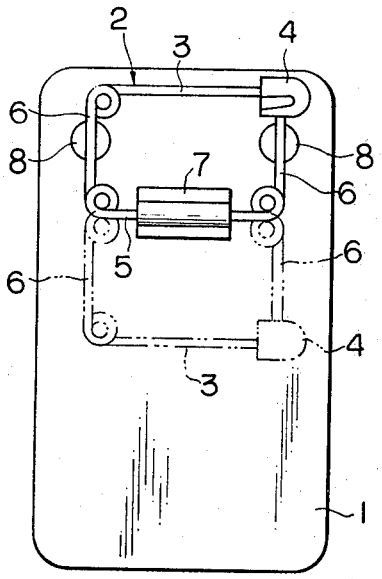
FIG. 1 shows a back surface of a badge according to the present invention.

Shown at 1 is a display tag such as identification tag, on the top surface of which a user's name, one's position in a company, etc. are written. A configuration and a size of the tag are selective out of the known name tags. Shown at 2 is a safety pin which comprises a resilient wire member bent substantially in a rectangle in a manner that the opposite ends thereof are positioned at one corner of the rectangular wire member, and having an insertion prong or needle 3 and a hook portion 4. Respective sides of the rectangular wire member 2 constitute the insertion prong 3, a support prong 6, a support stem 5 and another support prong 6. The insertion prong 3 is tapered to one end, thus forming a sharp point thereat. The rectangular wire member is coiled at three corners excluding a corner at which the hook 4 is formed. A size and a configuration of the hook 4 with which the insertion prong 3 is brought into engagement are selective from those of the prior art safety pins. The support prongs 6 and 6 for supporting the insertion prong 3 and the hook 4 preferably are as long as possible within the limit of not projecting from the outer circumferential edge of the display tag 1 to which the pin is attached, so as not impair the external appearance of the display tag. Shown at 7 is a bearing for pivotally movably securing the support stem 5 of the pin 2 to the reverse surface of the display tag 1. Magnets 8 magnetically attract the support prongs 6 and 6, so as to settle the pin in place.

Figure 2:
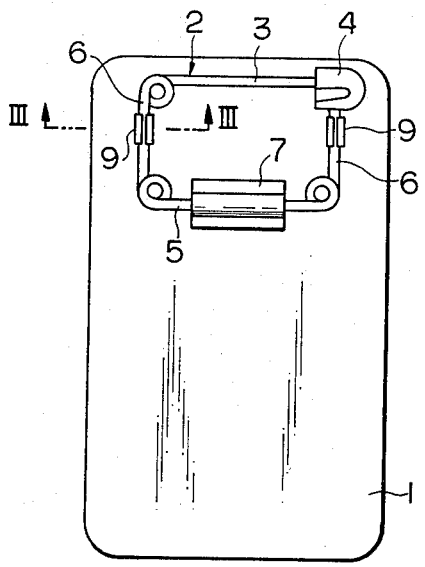
FIG. 2 shows a back surface of a badge according to another embodiment, wherein a resilient hook is provided, instead of a magnet.
Figure 3:
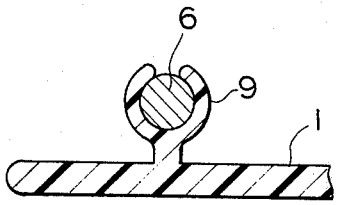
FIG. 3 is a cross sectional view taken along the line III—III of FIG. 3; and, FIG. 4 shows the badge of the present invention held on the hem of a pocket in a garment.

Means for preventing the display tag 1 from dangling which would be caused by an increased length of the support prongs 6, after the insertion prong 3 has been locked by the hook 4 may be a hook 9 as shown in FIGS. 2 and 3, instead of magnets 8. The hook 9 has an inverted C-shaped cross section and is formed integrally with the display tag 1. When each support prongs 6 is formed into the hook 9 through the cut provided therein, the hook 9 is elastically deformed radially of the C-shaped cross section.

The badge to which the pin so far described has been attached is affixed to a garment a by engaging the insertion prong 3 with the hook 4 both of which are supported by long support prongs 6 and 6.

According to the present invention, since the pin has long support prongs 6 and 6 for supporting the insertion prong 3 and the hook 4 on the back surface of the display tag or badge 1, one permits to handle the insertion prong 3 from a position remote from the back surface of the badge or display tag, so that engagement or disengagement of the insertion prong 3 with or from the hook 4 is facilitated. Thus, ease of attachment or removal of the badge to the garment results.

Figure 4:
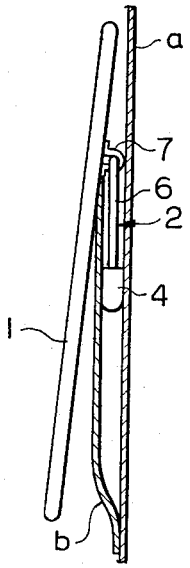

The badge to which the pin according to the present invention has been attached can be stably held on a hem or edge of a pocket in a garment. In this case, the pin should be pivotally moved downward to a second service position on the back surface of the badge, and with the pin maintained in the second service position, the pin is inserted into a pocket b in the garment a in the manner shown in FIG. 4, whereby the badge is stably held on the hem or edge of the pocket without causing the pin to pierce through the garment.

What is claimed is:

1. A badge comprising a pin pivotally movable attached to the back surface of the badge, said pin being a resilient wire member bent substantially in a rectangle, with the opposite ends thereof positioned at one corner thereof, said wire member having a hook portion at one end thereof and a sharp point at the other end, which is adapted to engage said hook portion, said resilient wire member having the distance between a prong thereof with the sharp point and a prong opposite thereto larger than the thickness of a thumb or forefinger, said wire member is coiled at the other end of the prong with a sharp point, which is remote from said hook, two opposing sides of the rectangular wire member which interconnect the prong with a sharp point and the prong opposite thereto which forms a support stem constitute support prongs; and said badge has on the back surface thereof a means for separably fixing said support prongs to the back surface of the badge.

2. A badge according to claim 1, wherein said means for separably fixing the support prong is a magnet.

3. A badge according to claim 1, wherein a means for separately fixing the support prongs is a resilient hook having a C-shaped cross section.

4. A badge comprising:

a pin pivotally movably attached to the back surface of the badge, said pin being a resilient wire member bent substantially in a rectangle, with the opposite ends thereof positioned at one corner thereof, said wire member having a hook portion at one end thereof and a sharp point at the other end, which is adapted to engage said hook portion, said resilient wire member having the distance between a prong thereof with the sharp point and a prong opposite thereto larger than the thickness of a thumb or forefinger, said wire member is coiled at the other end of the prong with a sharp point, which is remote from said hook, said rectangular wire member comprising a pair of support prongs extending transversely of the prong with a sharper point, a means for separately fixing said support prongs to the back surface of the badge, said means comprising a support for fixing the support prongs.

* * * * *